US008184058B2

(12) United States Patent
Swanson

(10) Patent No.: US 8,184,058 B2
(45) Date of Patent: May 22, 2012

(54) TORQUE ARM ASSEMBLY

(75) Inventor: Jeffrey C. Swanson, Clay, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 392 days.

(21) Appl. No.: 12/582,877

(22) Filed: Oct. 21, 2009

(65) Prior Publication Data

US 2011/0090127 A1 Apr. 21, 2011

(51) Int. Cl.
*H01Q 3/00* (2006.01)

(52) U.S. Cl. ..... 343/763; 343/757

(58) Field of Classification Search ..... None
See application file for complete search history.

(56) References Cited

U.S. PATENT DOCUMENTS 5,203,232 A 4/1993 Ito et al.
5,373,923 A 12/1994 Koenig
6,412,589 B1 7/2002 Barlage et al.
6,827,175 B1 12/2004 Frazer et al.
7,177,242 B2 2/2007 Shibuya et al.
7,207,574 B2 4/2007 Gradu et al.
7,256,748 B2 * 8/2007 Tietjen ..... 343/763
7,404,545 B2 7/2008 Steiner et al.
2006/0139224 A1 * 6/2006 Tietjen ..... 343/757
2008/0073994 A1 3/2008 Fedder et al.
2009/0160152 A1 6/2009 Mikels et al.

* cited by examiner

*Primary Examiner* — Trinh Dinh
(74) *Attorney, Agent, or Firm* — Howard IP Law Group, PC

(57) ABSTRACT

A torque arm assembly for connecting first generally circular cylindrical and second rotatable concentric bodies, rotatable about a common axis of rotation and separated by a given radial distance defined between the inner surface of the first rotatable body and the outer surface of the second rotatable body. The assembly includes an axial assembly positioned along the radial axis between the rotatable bodies and having a first end coupled to the first rotatable body and a second end coupled to a transverse body. A transverse shaft is fixedly coupled to the second rotatable body via a pair of support members. The transverse body is adapted to translate along an axis, transverse to the radial axis and relative to the transverse shaft. The axial assembly has a length that is axially variable to compensate for variations in the given radial distance between the rotatable bodies during rotation of the rotatable bodies.

17 Claims, 7 Drawing Sheets

TORQUE ARM ASSEMBLY

FIELD OF INVENTION

The present invention relates in general to torque arms and in particular to torque arm assemblies for connecting two rotatable bodies.

BACKGROUND

Torque arms have been used to connect a first rotatable body (driven, for example, by a motor) to a second concentric rotatable body (driven by the first rotatable body), both rotating about a common axis of rotation. For example, referring to FIG. 1, a torque arm 130 connects a first hollow cylindrical rotatable body 120 (such as a hollow drum driven by a motor) to a second concentric rotatable body 110, (such as a body surrounded first rotatable body). Second rotatable body 120 is driven by first rotatable body 110 via torque arm 130. First and second rotatable bodies are separated by a radial distance 140. Torque arm 130 may take the form of a threaded, rigid bar (i.e. a torque bar) having a length substantially equal to radial distance 140. First rotatable body 110 rotates about an axis 115, running perpendicular to the plane of the paper of FIG. 1. Similarly, second rotatable body 120 rotates about an axis 125 running perpendicular to the plane of the paper of FIG. 1. Ideally, axes 115, 125 coincide such that both bodies 110, 120 rotate about a common axis of rotation 125. Under ideal conditions, second rotatable body 120 rotates with the same angular velocity as that of first rotatable body 110, about the common axis 125 of rotation. As a result, a given point on first rotatable body 110, for example, point 117 and a given point on second rotatable body 120, for example, point 127 are always linearly aligned along a given diameter of first rotatable body 110, during the rotations of first and second rotatable bodies 110, 120. Thus, a position encoder may be disposed on second rotatable body 120 to determine the angular orientation of first rotatable body 110 relative to axis 125 of rotation.

However, during the rotation of first and second rotatable bodies 110, 120, radial distance 140 therebetween may vary because of component run-outs and/or variations in the axes 115, 125 of rotations of bodies 110, 120. As is known in the art, component run-out refers to the variation in the radial distance of a given point on an outer surface of a rotating component relative to the axis of rotation, due to, for example, an imbalance of material of the rotating body on one side as compared to the other side, as the component is rotated through a 360° rotation. Torque bars 130 are, therefore, subject to deflection and/or bending due to variations in the radial distance (represented by reference number 140) between first and second rotating bodies 110, 120. One such variation in radial distance 140 due to a variation in axis 125 (e.g. represented by reference numeral 125) from the common axis 125 of rotation of second rotatable body 120 and the resulting bending of torque bar 130 are schematically illustrated in broken lines (130, 130) in FIG. 1. Bending and/or deflection of torque bar 130 may result in a misalignment between first and second rotatable bodies 110, 120 (as represented by non-linear orientation of point 117 on first rotatable body and point 127 on second rotatable body relative to a diameter of first rotating body 110. Such misalignment between first and second rotatable bodies 110, 120 renders the positional measurements of an encoder disposed on second rotatable body 120 inaccurate and unreliable.

One example where such a torque bar may be used is a radar system wherein a radar antenna is mounted on a rotatable platform. The rotatable platform is configured to continuously rotate (e.g. via a drive motor assembly) about a central axis through three hundred and sixty degrees of rotation. As is known in the art, such a radar antenna uses an electromechanical connection, which is most often referred to as a'slip ring, to transmit electrical signals between a stationary structure (such as a grounding connection) to the rotatable platform which includes the radar antenna. As is known in the art, a slip ring has a rotatable component generally tracking the rotatable platform and a stationary component in at least electrical communication with the rotatable component. Radar slip rings may further include a position or azimuth encoder to determine the relative angle of the rotatable component (and thereby that of the rotatable platform) with respect to the stationary component of the slip ring and ultimately determine the angular orientation of the rotatable radar antenna.

Under ideal conditions, the rotatable component of the radar slip-ring and the rotatable platform would have the same or consistent angular bearing relative to the stationary component of the radar slip-ring. A signal generating component of the encoder may, therefore, be mounted on the rotatable component of the slip ring and a reference component of the encoder may be mounted on the stationary component of the slip ring. However, the variations in the axes of rotation of the rotating platform and the rotating component of the slip ring and component run-outs of these rotatable parts may cause undesirable bending and/or deflection of a conventional torque bar connecting the rotatable component of the slip ring and the rotatable platform of the radar, as described above. Such undesirable bending may introduce positional or angular misalignment between the rotating platform and the rotating component of the slip-ring, thereby rendering the positional measurements of the encoder generally unreliable and inaccurate. This, in turn, may adversely affect the performance of the rotatable radar antenna. Alternatives to conventional threaded, rigid torque bars are, therefore, desirable for mitigating these adverse effects on positional accuracy measurements.

SUMMARY OF THE INVENTION

According to an embodiment of the invention, a torque arm assembly connects a first generally hollow cylindrical rotatable body and a second rotatable body surrounded by the first body, both bodies separated by a given radial distance defined between the inner surface of the first rotatable body and the outer surface of the second rotatable body. The assembly includes an axial assembly positioned along the radial axis between the first and second rotatable bodies. The axial assembly has a first end coupled to the first rotatable body and a second end coupled to a transverse body. A transverse shaft is fixedly coupled to the second rotatable body via at least a pair of support members. The transverse body is adapted to translate along a transverse axis, transverse to the radial axis, and relative to the transverse shaft. The at least one pair of support members limits the translation of the transverse body along the transverse axis relative to the transverse shaft. The axial assembly has a length that is axially variable to compensate for variations in the given radial distance between the first and second rotatable bodies during the rotation of the first and second bodies.

In an embodiment of the invention, the axial assembly includes a linear bearing fixedly mounted on the transverse body and an axial shaft having first and second ends and movably coupled to the linear bearing. The first end of the axial shaft is adapted to pivotably couple to the first rotatable body and the second end of the axial shaft is adapted to translate within and relative to the linear bearing.

According to an embodiment of the invention, the transverse body includes a mounting plate having first and second major surfaces. The second end of the axial assembly is fixedly coupled to the first major surface. The transverse body further includes at least one linear bushing mounted on the second major surface. The at least one linear bushing is adapted to cooperatively couple to and translate relative to the transverse shaft.

According to an aspect of the present invention, a method for coupling a first generally hollow cylindrical rotatable body to a second rotatable body surrounded by the first body is described. The first and second bodies are separated by a given radial distance defined between the inner surface of the first rotatable body and the outer surface of the second rotatable body. The method includes the step of fixedly coupling a transverse shaft to the second rotatable body via at least a pair of support members. The method further includes the step of translatably coupling a transverse body to the transverse shaft, wherein the transverse body is adapted to translate relative to the transverse shaft. The method also includes the step of fixedly coupling an axial assembly to the transverse body, wherein the axial assembly is positioned about the radial axis between the rotatable bodies. The axial assembly has a first end fixedly coupled to the first rotatable body and a second end fixedly coupled to the transverse body. The at least one pair of support members limit the translation of the transverse body along the transverse axis relative to the transverse shaft. The transverse body is adapted to translate along a transverse axis, transverse to the radial axis and relative to the transverse shaft. The axial assembly has a length that is axially variable to compensate for variations in the given radial distance between the first and second rotatable bodies during rotation of the first and second rotatable bodies.

According to an embodiment of the invention, a rotatable radar antenna system includes a rotatable platform adapted to receive a radar antenna thereon and a radar slip ring having a rotatable component and a stationary component. The rotatable component is rotatable about generally the same axis of rotation as the rotatable platform. The rotatable platform and the rotatable component are separated by a given radial distance. The system further includes a torque arm assembly connecting the rotatable component of the radar slip ring to the rotatable platform. The torque arm assembly includes an axial assembly positioned along the radial axis between the rotatable bodies and has a first end fixedly coupled to the rotatable platform and a second end fixedly coupled to a transverse body. A transverse shaft is fixedly coupled to the rotatable component of the radar slip ring via at least a pair of support members. The transverse body is adapted to translate along a transverse axis, transverse to the radial axis and relative to the transverse shaft. The at least one pair of supporting members limits the translation of the transverse body along the transverse axis relative to the transverse shaft. The axial assembly has a length that is axially variable to compensate for variations in the given radial distance between the rotatable platform and the rotatable component during rotation of the rotatable platform and the rotatable component of the radar slip ring.

BRIEF DESCRIPTION OF THE DRAWINGS

Understanding of the present invention will be facilitated by consideration of the following detailed description of the exemplary embodiments of the present invention taken in conjunction with the accompanying drawings, in which like numerals refer to like parts and in which.

DETAILED DESCRIPTION

Figure 1:
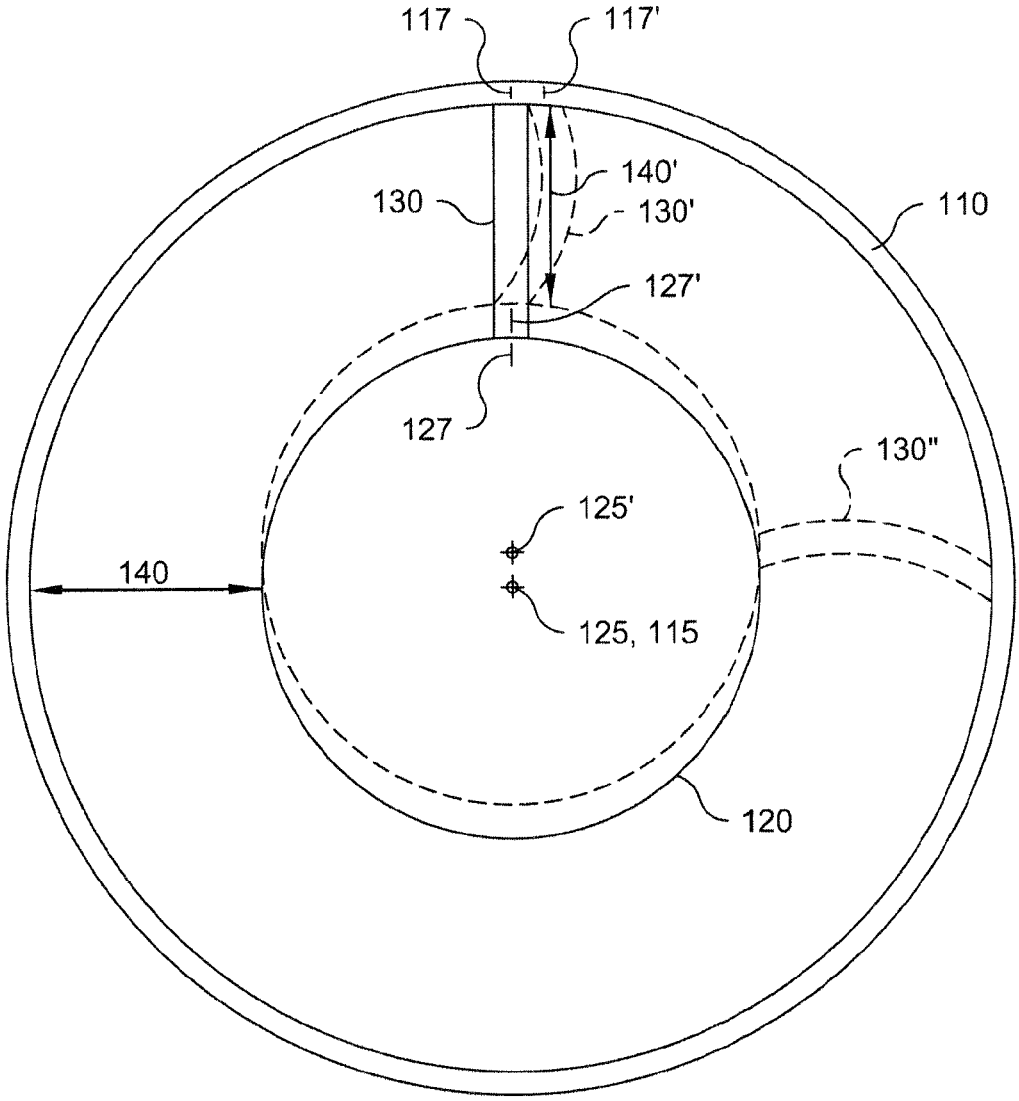
Fig. 1 (Prior Art)
FIG. 1 is a schematic view of a prior art torque arm connecting two coaxially rotating bodies.

In the following detailed description, reference is made to the accompanying drawings that show, by way of illustration, specific embodiments in which the invention may be practiced. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout several views.

Figure 2A:
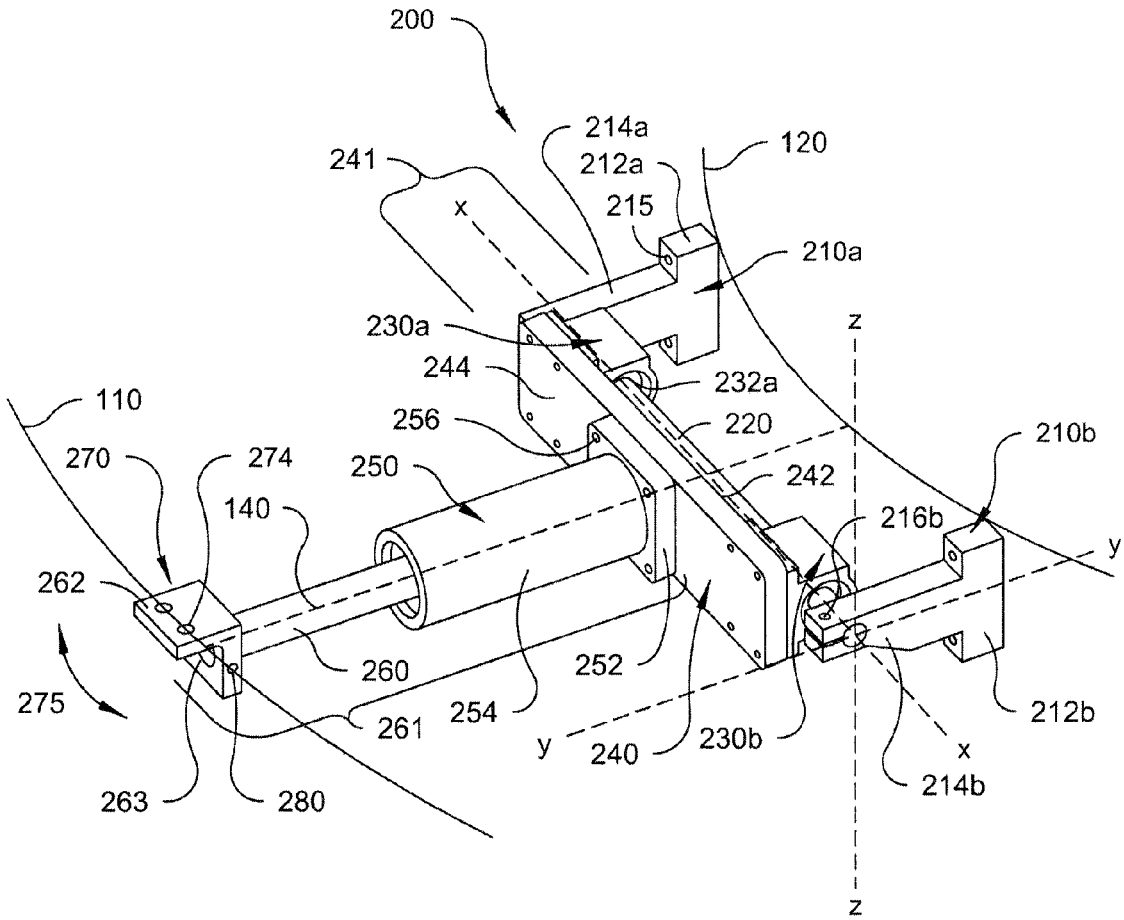
FIG. 2A is a torque arm assembly for connecting two coaxially rotating bodies, according to an embodiment of the invention.

Referring now to FIGS. 2A'2E, different views of torque arm assembly 200 are illustrated, according to an embodiment of the invention. In one configuration, torque arm assembly 200 may be used to connect a first generally circular cylindrical rotatable body 110 and a second concentric rotatable body 120, both bodies rotatable about a generally common axis (not shown) of rotation and rotatable at substantially similar angular velocities. In other configurations, torque arm assembly 200 may be used to first and second rotatable bodies rotatable about different axes of rotation and at substantially similar angular velocities. As shown therein, torque arm assembly 200 includes an axial assembly 261 comprising an axially translatable rod 260 and bearing mount 250 positioned along the radial axis 140 between the rotatable bodies 110, 120 (schematically represented in FIG. 2A). The axial assembly 261 has a first end 262 fixedly coupled to the first rotatable body 110 and a second end 252 fixedly coupled to a transverse body designated generally as 241. Transverse body 241 is adapted to translate along a transverse axis x-x, transverse to the radial axis 140, and relative to an elongate transverse rod or shaft 220. At least a pair of support members labeled generally as 210 fixedly couples the transverse rod 220 to the second rotatable body 120. The pair of support members 220 further serves to limit translation of the transverse body 241 along the transverse axis x-x relative to the transverse rod 220. The support members 210*a*, 210*b* are adapted to fixedly couple to the second rotatable body 120. The axial assembly 261 is configured such that its length 267 (see FIG. 2C) is axially variable to compensate for variations in the given radial distance 140 between the first and second rotatable bodies 110, 120 during rotation of the bodies 110, 120.

In one configuration, each support member (210*a*, 210*b*) has a first end 212 adapted to fixedly couple to a corresponding section of second rotatable body 120 and a second end 214 adapted to support and fixedly retain transverse shaft 220. The support members 210*a*, 210*b* extend from the second rotatable body 120 as shown in FIG. 2A. The transverse shaft 220 is configured along axis x-x transverse to the radial direction 140.

A mounting plate 240 comprises a substantially planar body and has a first major surface 242 on which is fixedly mounted a pair of bushings 230*a*, 230*b* separated from one another along the x-x axis, according to an exemplary embodiment of the invention. The bushings 230*a*, 230*b* are configured with corresponding openings 232*a*, 232*b* to receive the transverse shaft 220 along the x-x axis. The bushings 230*a*, 230*b* are translatable relative to transverse shaft 220 along the x-x axis. Support members 210*a*, 210*b* operate as stops to block further translation of the bushings 210*a*, 210*b* relative to transverse shaft 220 along the x-x axis.

Mounting plate 240 includes a second major surface 244 opposite first major surface 242 on which is mounted axial bearing mount 250. Axial bearing mount 250 is adapted to receive axial shaft 260. The axial bearing mount 250 and axial shaft 260 are positioned generally orthogonal to transverse shaft 220 and the first and second major surfaces of mounting plate 240. Axial shaft 260 is translatable axially with respect to axial bearing mount 250. The axial bearing mount 250 and axial shaft 260 extend radially from the rotatable body 120, i.e., generally parallel to the axis y-y shown in FIG. 2A. Axial shaft 260 has a first end 263 adapted to be coupled to first rotatable body 110. Second end 264 (see FIG. 2C) of axial shaft 260 is translatable axially within bearing mount 250. During operation, the rotatable bodies 110, 120 connected to one another via the torque arm assembly 200 may exhibit rotation variations such as variations in the radial distance 140 between first and second rotatable bodies 110, 120. Such rotation variations may be caused by the divergence of one or both of the axes of rotation 115, 125 of the first and second rotatable bodies 110, 120 from their common axis of rotation. The axial shaft 260 and bearing mount 250 adaptively control radial translation (i.e. in and'out movement along the y-y axis) of the torque arm assembly 200. The bushings 230*a*, 230*b* are translatable relative to transverse shaft 220 and constrained via support members 210*a*, 210*b* adaptively control the transverse motion (i.e.'lateral or'side to side movement along the-x axis) of the torque arm assembly 200.

Figure 2B:
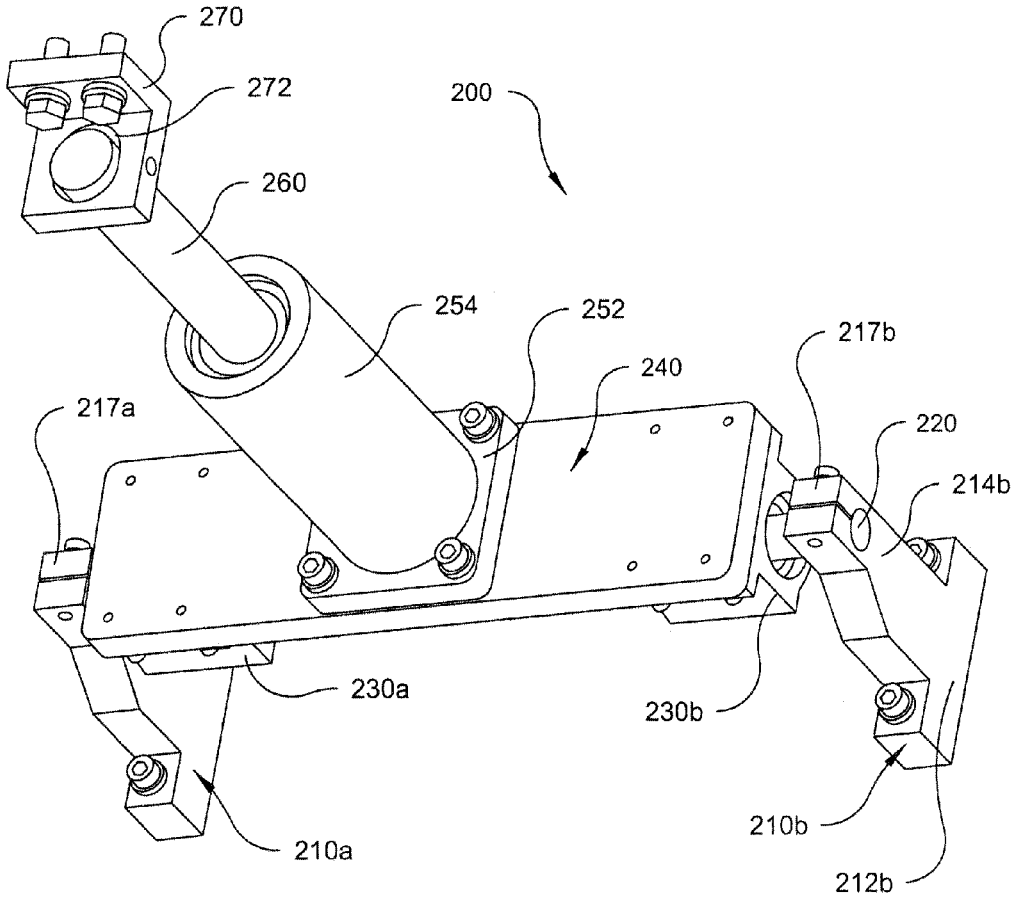
FIG. 2B is another perspective view of the torque arm assembly of FIG. 2A.
Figure 2C:
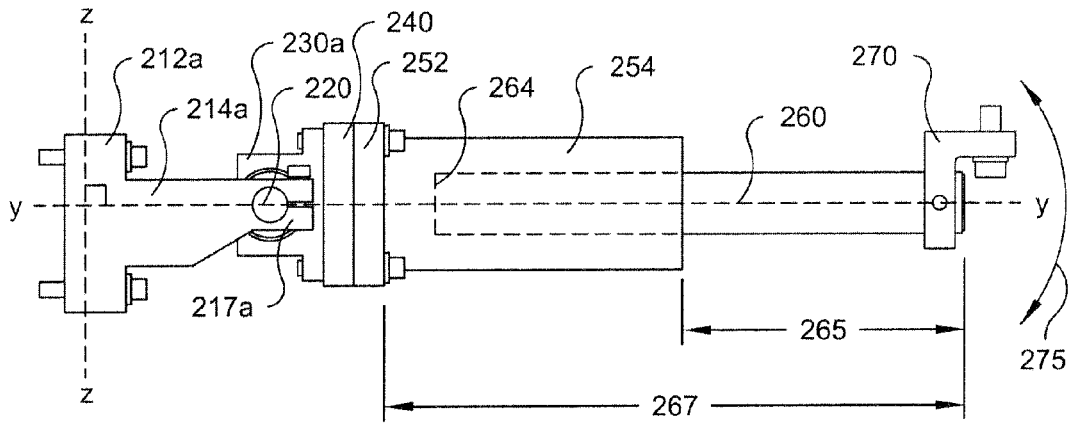
FIG. 2C is a right side elevational view of the torque arm assembly of FIG. 2A, according to an embodiment of the invention.
Figure 2D:
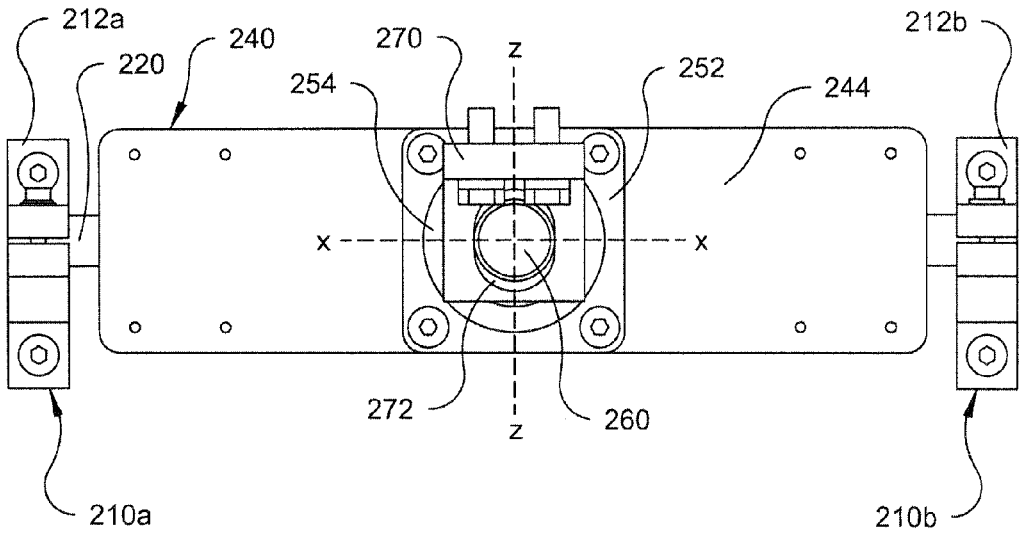
FIG. 2D is a front elevational view of the torque arm assembly of FIG. 2A, according to an embodiment of the invention.

As further shown in FIG. 2A, a bracket 270 pivotably couples first end 262 of axial shaft 260 to rotatable body 110. In the illustrated embodiment, bracket 270 is an inverted-L bracket. Other types of connectors may be used depending on the requirements of a given application. Bracket 270 includes a central opening 272 (see FIGS. 2B, 2D) adapted to receive axial shaft first end 262. As shown in FIG. 2D, opening 272 is elongated along the z-z axis and provides a predetermined radial separation or gap between bracket 270 and shaft 260 along the z-z axis. Opening 272 may be sized to fit shaft 260 in a direction along the x-x axis. This configuration permits bracket 270 to pivot about the direction of the x-x axis while restraining movement of bracket 270 along the direction of the z-z axis. This pivoting action of bracket 270 compensates for any vertical misalignment (i.e., along the direction of z-z axis) between first and second rotatable bodies 110, 120.

In the exemplary embodiment, bracket 270 further includes one or more through holes 274 adapted to receive corresponding one or more fasteners (e.g. bolts) to fixedly couple bracket 270 to the first rotatable body 110, such as a rotatable platform.

Support Members

Support members 210*a*, 210*b* are adapted to be rigidly or fixedly coupled to second rotatable member 120, such as a rotatable component of a radar slip ring. Support members 210*a*, 210*b* are further adapted to receive and fixedly retain transverse shaft 220 therebetween. Referring particularly to FIG. 2C, in an exemplary embodiment, supporting members 210*a*, 210*b* include bases 212*a*, 212*b* and arms 214*a*, 214*b* respectively. In the illustrated embodiment, arms 214*a*, 214*b* extend generally orthogonally along the y-y axis from respective bases 212*a*, 212*b* in the y-z plane. In other embodiments, arms 214*a*, 214*b* may extend from respective bases 212*a*, 212*b* at an angle other than 90° relative to the z-z axis, depending on the requirements of a given application. It is also conceivable that arms 214*a*, 214*b* may extend from their respective bases 212*a*, 212*b* in a three-dimensional space further defined by the x-x axis, perpendicular to both the z-axis and the y-axis. In one configuration, bases 212*a*, 212*b* may include one or more through holes 215. Through holes 215 are adapted to receive one or more corresponding fasteners, for example, bolts, to rigidly couple support members 210*a*, 210*b*, via base 212, to the second rotatable member 120.

Free ends of arms 214*a*, 214*b*, distal to their respective bases 212*a*, 212*b*, are adapted to receive and fixedly retain transverse shaft 220. By way of non-limiting example only, free ends of arms 214*a*, 214*b* may be configured with jaws 217*a*, 217*b* (see FIG. 2B) to receive and fixedly retain transverse shaft 220. Arms 214*a*, 214*b* may further have through holes 216*b* at their ends adapted to receive a fastener therein, to further secure transverse shaft 220 via the jaw ends of arms 214*a*, 214*b* in a clamping arrangement to reduce or eliminate slippage between transverse shaft 220 and the jaw ends of arms 214*a*, 214*b*.

Transverse Shaft

Still referring to FIGS. 2A'2E, in one configuration, transverse shaft 220 may take the form of a shaft-like structure having a uniform cross-section substantially along its length along the x-x axis. In the illustrated embodiment, transverse shaft 220 has a circular cross-section. In other embodiments, transverse shaft 220 may have other cross-section shapes such as oval or square. One skilled in the art will appreciate that an advantage of the circular cross-section of transverse shaft 220 is that in case of some vertical misalignment, i.e., along the z-z axis, between first and second bodies 110, 120, blocks 230*a*, 230*b* may rotate about transverse shaft 220. The length and cross-sectional area of transverse shaft 220 may be determined from the radial distance 140 between the first and second rotating bodies 110, 120 and torque transmitted therebetween by axial shaft 260. Generally, the larger the radial distance and the larger the torque transmitted, the larger the length and the larger the cross-sectional area of transverse shaft 220. In an exemplary embodiment, transverse shaft 220 may be made from stainless steel. In other embodiments, transverse shaft 220 may be made from other materials having suitable strength and weight characteristics. In one configuration, transverse shaft 220 may have a length of about 9 inches and a diameter of about ⅝ inches.

Mounting Plate

Mounting plate 240 includes a first surface 244 for mounting flange mount bearing 250. Mounting plate 240 is adapted to movably couple to transverse shaft 220 such that mounting plate 240 may move relative to transverse shaft 220 at least along the x-x axis. In an exemplary embodiment, first and second bushing pillow blocks 230*a*, 230*b* are fixedly mounted on a second surface 242, opposite first surface 244, of mounting plate 240, wherein pillow blocks 230*a*, 230*b* are movably coupled to transverse shaft 220. Appropriate fasteners or other fastening mechanisms may be used to rigidly or fixedly mount blocks 230*a*, 230*b* on mounting plate 240. In one configuration, blocks 230*a*, 230*b* may be integrally fabricated with mounting plate 240.

Depending on the requirements of a given application, mounting plate 240 may be mounted on less than two (2) or more than two (2) bushing pillow blocks. However, it should be noted that more than two (2) or less than two (2) pillow blocks may adversely affect the operation of assembly 200, for example, because of high frictional loads between the pillow blocks and transverse shaft 220, depending on the load on assembly 200. Thus, varying the number of blocks may either result in sub-optimal performance of assembly 200 or may even render the assembly 200 inoperable under certain conditions. In one configuration, blocks 230*a*, 230*b* may also rotate relative to transverse shaft 220, i.e., about the x-x axis. Blocks 230*a*, 230*b* each have respective through hole 232*a*, 232*b* adapted to receive transverse shaft 220. The inner cross-section of through holes 232*a*, 232*b* generally corresponds to the outer cross-section of transverse shaft 220 to minimize any radial gaps therebetween and to facilitate a sliding motion of blocks 230*a*, 230*b* along (i.e., relative to) transverse shaft 220 along the x-x axis. In one configuration, blocks 230*a*, 230*b* may be fabricated from polytetrafluoroethylene (PTFE), for example, available under the trademark Teflon®. In other configurations, blocks 230*a*, 230*b* may take the form of any other linear motion bearing adapted to reduce kinetic friction between blocks 230*a*, 230*b* and transverse shaft 220 and may be formed of a material having low coefficient of kinetic friction.

In an exemplary embodiment, the linear distance between blocks 230*a*, 230*b*, along transverse shaft 220 may be about half the length of axial shaft 260. It will, of course, be understood that the linear distance between blocks 230*a*, 230*b* may be varied for obtaining a desired moment distribution between blocks 230*a*, 230*b*, depending on the requirements of a given application. One of ordinary skill in the art would understand that the larger the linear distance between blocks 230*a*, 230*b*, the more even the moment distribution between blocks 230*a*, 230*b*. In one configuration, blocks 230*a*, 230*b* may be disposed symmetrically about the axis (see FIG. 2A) passing through axial shaft 260 and generally parallel to the y-y axis. Blocks 230*a*, 230*b* are so spaced apart as to prevent simultaneous respective surface engagements of block 230*a* and arm 214*a* and of block 230*b* and arm 214*b*. That is, if block 230*a* is in surface engagement with arm 214*a* during its sliding or moving motion along transverse shaft 220, block 230*b* is at a predetermined distance away from arm 214*b* and vice versa.

Translational Movement of Axial Shaft Assembly

Figure 2E:
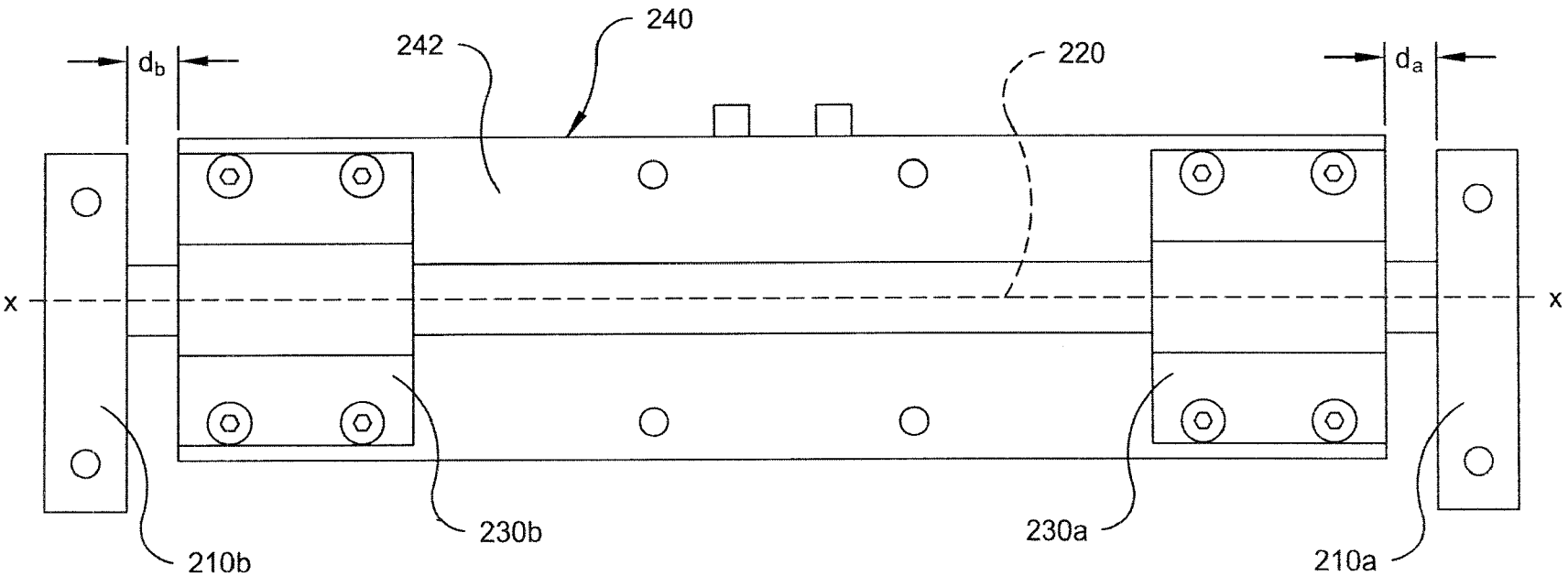
FIG. 2E is a rear elevational view of the torque arm assembly of FIG. 2A, according to an embodiment of the invention.

Referring particularly to FIG. 2E, predetermined distance $d_a$ defines the distance that can be travelled by block 230*a* along transverse shaft 220 toward arm 214*a* along the x-x axis from an initial position and predetermined distance $d_b$ defines the distance that can be travelled by block 230*b* along transverse shaft 220 toward arm 214*b* along the x-x axis from the initial position. Thus, the maximum distance that can be travelled by mounting plate 240 along transverse shaft 220 is $d_a+d_b$. The sliding motion of blocks 230*a*, 230*b* relative to transverse shaft 220 along the x-x axis is constrained by arms 214*a*, 214*b* along the respective ends of first elongate member 220.

In an exemplary embodiment, mounting plate 240 may be fabricated from aluminum. Other metals and materials may be used to fabricate mounting plate 240 in other embodiments, depending on the requirements of a given application. In the illustrated embodiment, mounting plate 240 takes the form of a generally rectangular slab having a length of about 10 inches, a width of about 2.75 inches and a thickness of about 0.5 inches. It will be understood, the dimensions of mounting plate 240 may be varied depending on the requirements of a given application. Mounting plate 240 is sufficiently long to facilitate mounting of bearing mount 252 on first major surface 244 and blocks 230*a*, 230*b* on second major surface 242.

Bearing Mount

Still referring to FIGS. 2A'2E, flange mount bearing 250 includes a flange mount or base 252 and a bearing element 254. Bearing 250 is mounted on second surface 244 of mounting plate 240, via flange mount 252. In the illustrated embodiment, flange mount 252 includes four (4) through holes 256. Through holes 256 are adapted to receive corresponding fasteners, for example, bolts, to fixedly mount flange mount 252 to mounting plate 240. In other embodiments, other fasteners and/or fastening mechanisms may be used to rigidly mount flange mount 252 to mounting plate 240. In an exemplary embodiment, flange mount bearing 250 may be fabricated from PTFE, available, for example, under trademark Teflon®. In other embodiments, bearing element 254 may be fabricated from a material having a low coefficient of kinetic friction to reduce the friction between bearing element 254 and axial shaft 260, as is known in the art. Bearing element 254 has a hollow opening adapted to receive and slidably engage axial shaft 260. In one configuration, bearing element 254 has a length approximately one half of the length of axial shaft 260. In an exemplary embodiment, bearing element 254 and axial shaft 260 are mounted generally orthogonally to mounting plate 240. End 264 (see FIG. 2C) of axial shaft 260 inserted into bearing element 254 may be free of any restraint.

Referring particularly to FIG. 2C, axial shaft 260 is adapted to slide or move in the directions shown by bidirectional arrow 265. Thus, a'length 267 of axial assembly 261 may be adjusted as axial shaft 260 slides'in or out of bearing element 254. That is, if axial shaft 260 slides'in toward bearing element 254, the'length 267 of axial assembly 261 decreases, whereas if axial shaft 260 slides'out away from bearing element 254, the'length 267 of axial assembly 261 increases. This'length adjustment of axial assembly 261 occurs automatically while first and second rotatable bodies 110, 120 are rotating, without any need of a manual intervention.

Radar System

Figure 3A:
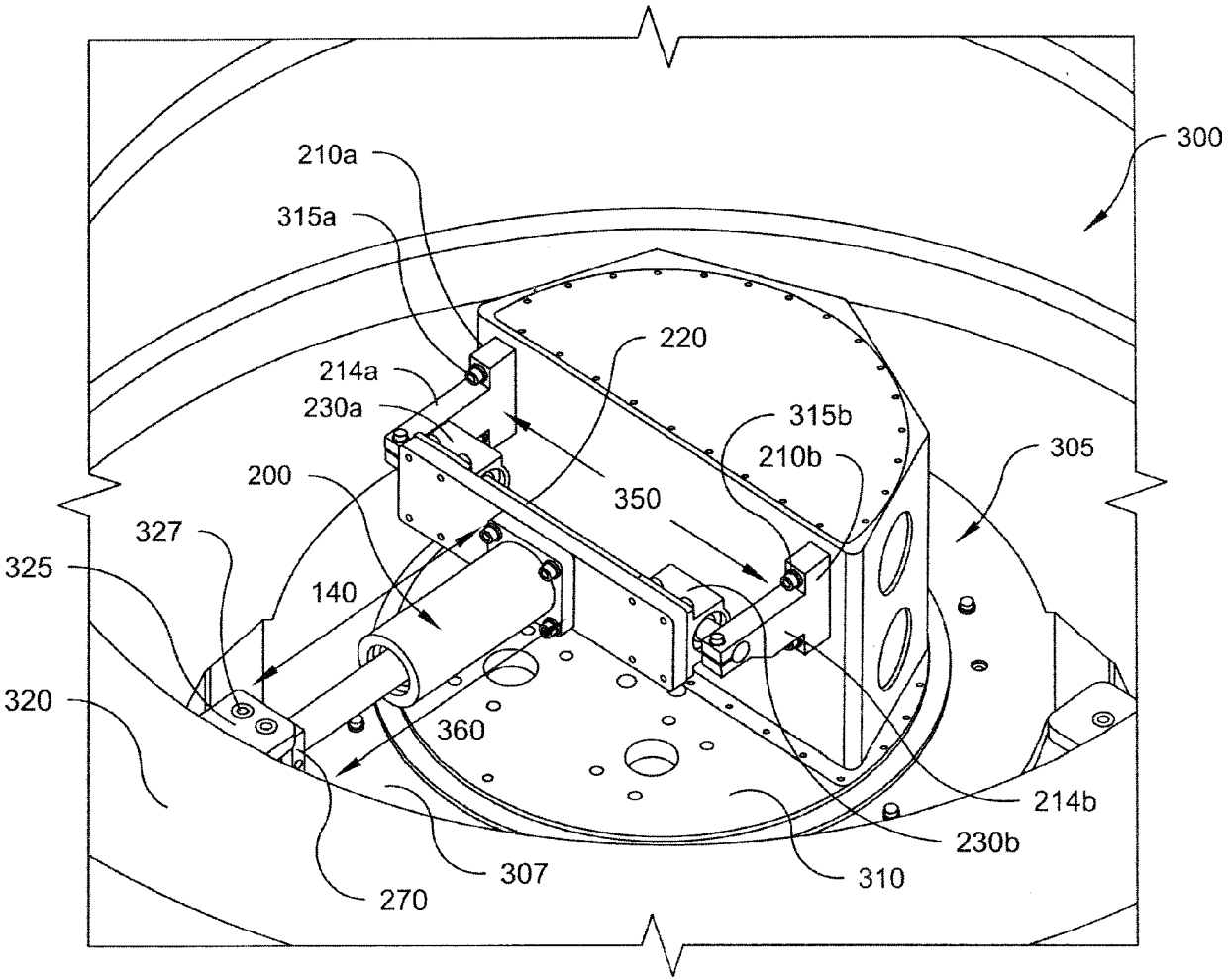
FIG. 3A illustrates the torque arm assembly of FIG. 2A coupling a rotating component of a radar slip ring to a rotating platform, according to an embodiment of the invention.
Figure 3B:
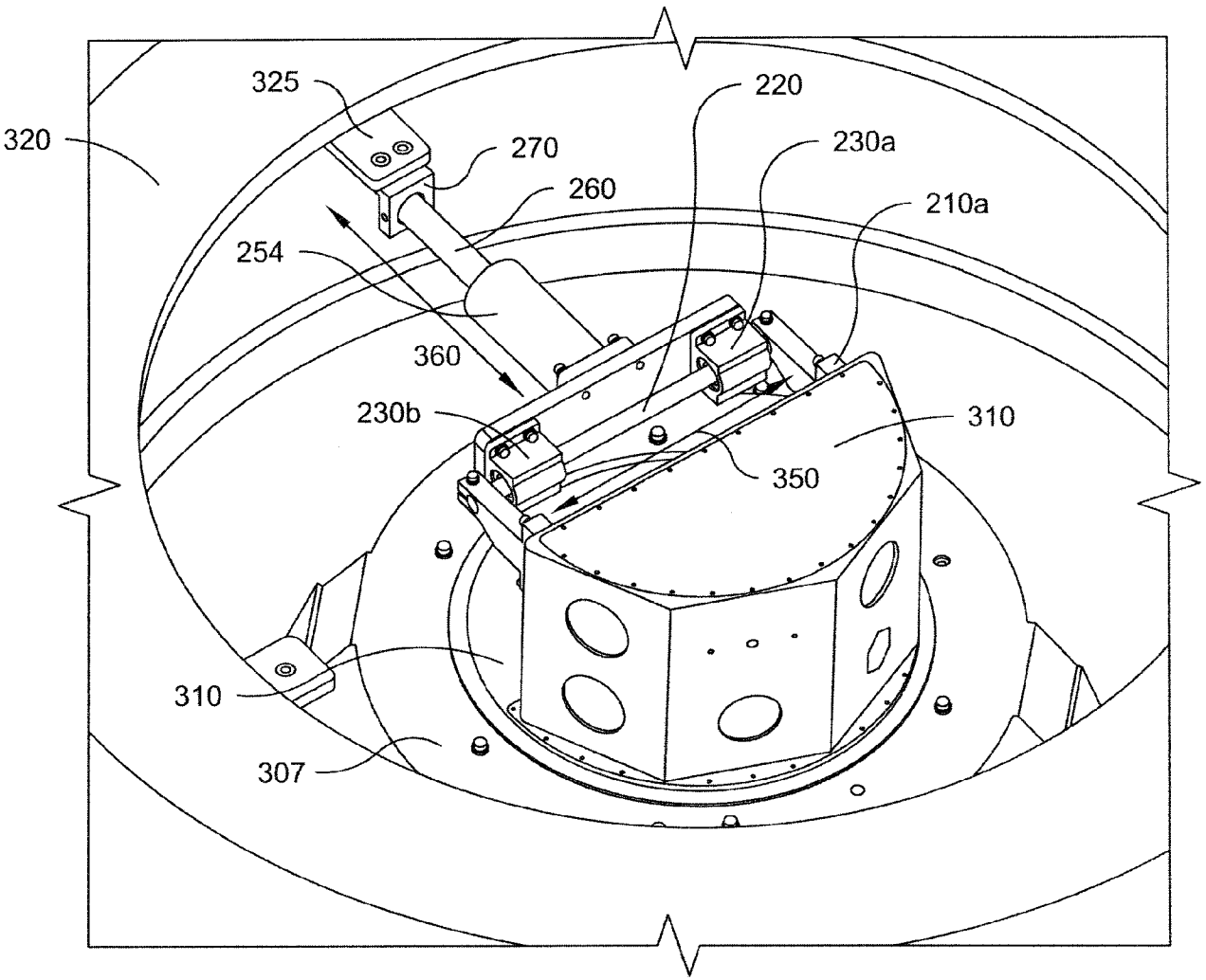
FIG. 3B illustrates another view of the torque arm assembly of FIG. 2A.

Referring now to FIGS. 3A 3B, the installation and the operation of torque arm assembly 200 on a radar antenna system 300 will be described. As is known in the art, a rotatable radar antenna system 300 includes a rotatable platform 320 on which a radar antenna (not shown) is mounted. A slip ring 305 is disposed coaxially with rotatable platform 320 such that both slip ring 305 and rotatable platform 320 have a generally common axis of rotation. Slip ring 305 is surrounded by rotatable platform 320. As is also known in the art, slip ring 305 has a first rotatable body or component 310 and a stationary component 307. In some radar antenna systems, slip ring 305 may contain coolant ports to deliver coolant to the antenna on rotatable platform 305. In the illustrated embodiment, the first rotatable component 310 is coupled to rotatable platform 320 via torque arm assembly 200. According to an embodiment of the invention, torque arm assembly 200 serves to maintain a consistent angular bearing of rotatable component 310 of slip ring 305 relative to rotatable platform 320. Assembly 200 is configured to compensate for variations in radial distance 140 between slip ring 305 and rotating platform 320. Such variations in the radial distance 140 may be caused by component run-out of rotatable platform 320 and/or rotatable component 310 as well as by divergence of the axes of rotation of rotatable platform 320 and/or rotatable component 310 from their common axis of rotation. Coolant delivery systems installed on slip ring 305 may introduce high drag torques opposing the torque transmitted from rotating platform 310 to rotatable component 305.

In one configuration, assembly 200 is rigidly or fixedly mounted on rotatable component 310 of radar slip ring 305 via fasteners 315 (for example, 315*a*, 315*b*, ") which pass through bases 210*a*, 210*b* as shown. Although the illustrated embodiment includes four (4) fasteners, other embodiments may have less than four (4) or more than four (4) fasteners. Other configurations may include other fastening mechanisms (for example, welding) for fixedly coupling bases 210*a*, 210*b* of assembly 200 to rotatable component 310. Bracket 270 is rigidly coupled to rotatable platform 320 via tab 325. In the illustrated embodiment, bracket 270 is fixedly coupled to tab 325 using fasteners 327, for example, bolts. Other configurations may include other fastening mechanisms to rigidly couple bracket 270 to rotatable platform 320.

Drag torques may be exerted on rotatable component 310, for example, caused by coolant delivery system. Such drag torques may cause rotatable component 310 to lag relative to rotatable platform 320 and cause undesirable bending and/or deflection of axial shaft 260. Axial shaft 260 may also be subjected to undesirable bending and/or deflection due to component run-outs and variations in the axes of rotation, as described herein. Torque arm assembly 200 provides at least two degrees of freedom to compensate for component runout and axis of rotation variations and to prevent or reduce undesirable bending and/or deflection of axial shaft 260. The first degree of freedom is illustrated by bi-directional arrow 350. Blocks 230*a*, 230*b* may translate (e.g. slide) along transverse shaft 220 in the directions shown by bidirectional arrow 350, thereby reducing the bending and/or deflection of axial shaft 260 caused by the aforementioned drag torques as well as variations in the axes of rotation of rotatable component 310 and rotatable platform 320. The second degree of flexibility is provided by the ability of axial shaft 260 to slide axially'in and out of bearing element 254 in the directions shown by bidirectional arrow 360, also reducing the bending and/or deflection of axial shaft 260. This second degree of flexibility compensates for the variations in the radial distance 140 between rotatable component 305 and rotatable platform 320 due to component run-outs and/or variation in their axes of rotation from the common axis of rotation.

When the radar antenna system 300 is in an operational mode, the radial distance 140 between rotatable platform 320 and rotatable component 310 may vary during operation. This may be due, at least in part, to component run-out and/or variations in axes of rotation for rotatable platform 320 and rotatable component 310. Such variations in the radial distance 140 are accommodated by torque arm assembly 200 automatically by adjusting the length 267 of the axial assembly 261 while the radar antenna system 300 is in an operational mode. As described herein, if the radial distance 140 between rotatable platform 320 and rotatable component 310 decreases due to component run-outs and/or variations in the axes of rotation, axial shaft 260 translates'in toward bearing mount 250, thereby preventing or reducing a bending of components of assembly about the y-y axis (see FIG. 2A). Similarly, if the radial distance increases due to component run-outs and/or variations in the axes of rotation, axial shaft 260 translates'out away from bearing mount 250, thereby preventing or reducing stresses on components of the assembly 200 as well as rotatable component 310. Assembly 200, thus, serves to reduce the bending and/or deflection associated with threaded, rigid bar 130 (of FIG. 1) and thereby to maintain a consistent angular bearing of rotatable platform 320 relative to rotatable component 310.

While the foregoing invention has been described with reference to the above-described embodiment, various modifications and changes can be made without departing from the spirit of the invention. Accordingly, all such modifications and changes are considered to be within the scope of the appended claims. Accordingly, the specification and the drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term'invention merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations of variations of various embodiments. Combinations of the above embodiments, and other embodiments not specifically described herein, will be apparent to those of skill in the art upon reviewing the above description.

What is claimed is:

1. A rotatable radar antenna system comprising:

a rotatable platform adapted to receive a radar antenna thereon;

a radar slip ring having a rotatable component and a stationary component, said rotatable component rotatable about generally the same axis of rotation as the rotatable platform, wherein the rotatable platform and the rotatable component are separated by a given radial distance; and a torque arm assembly connecting said rotatable component to said rotatable platform, said torque arm assembly comprising:

an axial assembly positioned along a radial axis between the rotatable platform and component, the assembly having a first end coupled to the rotatable platform and a second end coupled to a transverse body; and a transverse shaft fixedly coupled to the rotatable component via at least a pair of support members, wherein the transverse body is adapted to translate along a transverse axis (x-x) transverse to the radial axis and relative to the transverse shaft;

wherein the at least one pair of supporting members limit the translation of the transverse body along the transverse axis relative to the transverse shaft, and wherein the axial assembly has a length that is axially variable to compensate for variations in the given radial distance between the rotatable platform and the rotatable component during rotation of the rotatable platform and the rotatable component.

2. The rotatable radar antenna system of claim 1, wherein the axial assembly comprises:

a linear bearing fixedly mounted on the transverse body; and an axial shaft having first and second ends and movably coupled to the linear bearing, wherein the first end of the axial shaft is adapted to be pivotably coupled to the rotatable platform, and wherein the second end of the axial shaft is adapted to translate within and relative to the linear bearing.

3. The rotatable radar antenna system of claim 2, wherein the linear bearing comprises a polytetrafluoroethylene (PTFE) bearing.

4. The rotatable radar antenna system of claim 2, further comprising an L-bracket pivotably coupled to the first end of the axial shaft, wherein the L-bracket is adapted to be fixedly coupled to the rotatable platform, and wherein the L-bracket is adapted to pivot about an axis parallel to the transverse axis, relative to the axial shaft.

5. The rotatable radar antenna system of claim 2, wherein the transverse body comprises:

a mounting plate having first and second major surfaces; and a first and a second linear bushings mounted on the second major surface, wherein, the second end of the axial assembly is fixedly coupled to the first major surface, and wherein the first and second linear bushings are adapted to cooperatively couple to and translate relative to the transverse shaft.

6. The rotatable radar antenna system of claim 5, wherein the first and second linear bushings comprise polytetrafluoroethylene (PTFE) bushings.

7. A torque arm assembly for connecting a first generally hollow cylindrical body and a second rotatable body surrounded by first body, separated by a given radial distance defined between the inner surface of the first rotatable body and the outer surface of the second rotatable body, said assembly comprising:

an axial assembly positioned along a radial axis between the first and second rotatable bodies, the axial assembly having a first end coupled to the first rotatable body and a second end coupled to a transverse body; and a transverse shaft fixedly coupled to the second rotatable body via at least a pair of support members, wherein the transverse body is adapted to translate along a transverse axis (x-x) transverse to the radial axis and relative to the transverse shaft, wherein the at least one pair of support members limits the translation of the transverse body along the transverse axis relative to the transverse shaft, wherein the axial assembly has a length that is axially variable to compensate for variations in the given radial distance between the first and second rotatable bodies during rotation of said bodies.

8. The torque arm assembly of claim 1, wherein the axial assembly comprises:

a linear bearing fixedly mounted on the transverse body; and an axial shaft having first and second ends and movably coupled to the linear bearing, wherein the first end of the axial shaft is adapted to be pivotably coupled to the first rotatable body, and wherein the second end of the axial shaft is adapted to translate within and relative to the linear bearing.

9. The torque arm assembly of claim 8, wherein the linear bearing comprises a polytetrafluoroethylene (PTFE) bearing.

10. The torque arm assembly of claim 8, further comprising an L-bracket pivotably coupled to the first end of the axial shaft, wherein the L-bracket is adapted to be fixedly coupled to the first rotatable body, and wherein the L-bracket is adapted to pivot about an axis parallel to the transverse axis, relative to the axial shaft.

11. The torque arm assembly of claim 1, wherein the transverse body comprises:

a mounting plate having first and second major surfaces; and at least one linear bushing mounted on the second major surface, wherein, the second end of the axial assembly is fixedly coupled to the first major surface, and wherein the at least one linear bushing is adapted to cooperatively couple to and translate relative to the transverse shaft.

12. The torque arm assembly of claim 11 further comprising a second linear bushing mounted on the second major surface and disposed at a predetermined distance from the at least one linear bushing along the transverse shaft.

13. The torque arm assembly of claim 11, wherein the at least one linear bushing comprises a polytetrafluoroethylene (PTFE) bushing.

14. A method for coupling a first generally hollow cylindrical rotatable body to a second rotatable body surrounded by the first body, the first and second bodies separated by a given radial distance defined between the inner surface of the first rotatable body and the outer surface of the second rotatable body, the method comprising the steps of:

fixedly coupling a transverse shaft to the second rotatable body via at least a pair of support members;

translatably coupling a transverse body to the transverse shaft, wherein the transverse body is adapted to translate relative to the transverse shaft; and fixedly coupling an axial assembly to the transverse body, wherein the axial assembly is positioned along a radial axis between the rotatable bodies, the axial assembly having a first end fixedly coupled to the first rotatable body and a second end fixedly coupled to the transverse body, wherein the at least one pair of support members limit the translation of the transverse body along the transverse axis relative to the transverse shaft, wherein the transverse body is adapted to translate along a transverse axis (x-x) transverse to the radial axis and relative to the transverse shaft, and wherein the axial assembly has a length that is axially variable to compensate for variations in the given radial distance between the first and second rotatable bodies during the rotation of the first and second rotatable bodies.

15. The method of claim 14, further comprising the steps of:

fixedly mounting a linear bearing on the transverse body; and movably coupling an axial shaft having first and second ends to the linear bearing, wherein, the first end of the axial shaft is pivotably coupled to the first rotatable body, and wherein the second end of the axial shaft is translatably coupled within the linear bearing.

16. The method of claim 14, further comprising the steps of:

pivotably coupling an L-bracket to the first end of the axial shaft;

fixedly coupling the L-bracket to the first rotatable body, wherein the L-bracket is adapted to pivot about an axis parallel to the transverse axis, relative to the axial shaft.

17. The method of claim 14, further comprising the steps of:

fixedly coupling the second end of the axial assembly to a first major surface of a mounting plate;

mounting first and second linear bushings on a second major surface of the mounting plate; and translatably coupling first and second linear bushings to the transverse shaft.

* * * * *